US010600425B2

(12) United States Patent
Boehm et al.

(10) Patent No.: US 10,600,425 B2
(45) Date of Patent: Mar. 24, 2020

(54) METHOD AND APPARATUS FOR CONVERTING A CHANNEL-BASED 3D AUDIO SIGNAL TO AN HOA AUDIO SIGNAL

(71) Applicant: DOLBY LABORATORIES LICENSING CORPORATION, San Francisco, CA (US)

(72) Inventors: Johannes Boehm, Göttingen (DE); Xiaoming Chen, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 34 days.

(21) Appl. No.: 15/771,084

(22) PCT Filed: Nov. 16, 2016

(86) PCT No.: PCT/EP2016/077893
§ 371 (c)(1),
(2) Date: Apr. 25, 2018

(87) PCT Pub. No.: WO2017/085140
PCT Pub. Date: May 26, 2017

(65) Prior Publication Data

US 2018/0315432 A1 Nov. 1, 2018

(30) Foreign Application Priority Data

Nov. 17, 2015 (EP) ..... 15306819

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01)

(58) Field of Classification Search
USPC ..... 704/500–504
See application file for complete search history.

(56) References Cited

U.S. PATENT DOCUMENTS

2014/0358563 A1* 12/2014 Sen ..... G10L 19/20 704/500
2015/0154965 A1 6/2015 Wuebbolt
(Continued)

OTHER PUBLICATIONS

Ando, A. et al "Sound Intensity Based Three-Dimensional Panning" AES presented at the 126th Convention, May 1-10, 2009, Munich, Germany, pp. 1-9.
(Continued)

*Primary Examiner* — Leonard Saint Cyr

(57) ABSTRACT

A system for converting a channel-based 3D audio signal to a higher-order Ambisonics HOA audio signal, the channel-based 3D audio signal is transformed from time domain to frequency domain. A primary ambient decomposition is carried out for three-channel triplets of blocks of the domain channel-based 3D audio signal, wherein directional signals and ambient signals are provided for each triplet. From the directional signals directional information of a total directional signal for each triple is derived. That total directional signal is HOA encoded according to the derived directions, and ambient signals are HOA encoded according to channel positions. The HOA coefficients of the HOA encoded directional signal and the HOA coefficients of the HOA encoded ambient signal are superimposed in order to obtain a HOA coefficients signal for the channel-based 3D audio signal, followed by a transformation into time domain.

15 Claims, 3 Drawing Sheets

(56) References Cited

U.S. PATENT DOCUMENTS

| | | | | |
|---|---|---|---|---|
| 2015/0154971 | A1* | 6/2015 | Boehm | G10L 19/008 704/500 |
| 2015/0213803 | A1* | 7/2015 | Peters | G10L 19/002 704/500 |
| 2016/0007132 | A1* | 1/2016 | Peters | G10L 19/008 381/17 |

OTHER PUBLICATIONS

Barber, C. Bradford, et al "The Quickhull Algorithm for Convex Hulls" ACM Transactions on Mathematical Software, vol. 22, No. 4, Dec. 1996, pp. 469-483.

Delaunay, Par B. "Sur La Sphere Vide" A la Memoire de Georges Voronoi, No. 6, 1934, pp. 793-800.

Faller, C. et al "Binaural Cue Coding—Part II: Schemes and Applications" IEEE Transactions on Speech and Audio Processing, vol. 11, No. 6, Nov. 2003, pp. 520-531.

Faller, Christoff "Multiple-Loudspeaker Playback of Stereo Signals" J. Audio Engineering Society, vol. 54, No. 11, Nov. 2006, pp. 1051-1064.

Earl G. Williams "Fourier Acoustics", Chapter 6, Spherical Waves, Academic Press, Jan. 1, 1999.

ISO/IEC JTC1/SC 29/WG 11 "Information Technology—High Efficiency Coding and Media Delivery in Heterogenous Environments—Part 3:3D Audio" Jul. 25, 2014.

Merimaa, J. et al "Correlation-Based Ambience Extraction from Stereo Recordings" AES presented at the 123rd Convention, Oct. 5-8, 2007, New York, NY, pp. 1-15.

NHK "22.2 Multichannel Audio Format Standardization Activity" Broadcast Technology No. 45, Summer 2011.

Pulkki, V "Virtual Sound Source Positioning Using Vector base Amplitude Panning" J. Audio Engineering Society, vol. 45, No. 6, Jun. 1997 pp. 456-466.

Rafaely, B. "Plane Wave Decomposition of the Sound Field on a Sphere by Spherical Convolution" ISVR Technical Memorandum 910, May 2003, pp. 1-40.

Thompson, J. et al "Direct-Diffuse Decomposition of Multichannel Signals Using a System of Pairwise Correlations" AES presented at the 133rd Convention, Oct. 26-29, 2012, San Francisco, CA, USA, pp. 1-15.

Van Baelen, W. et al "Auro-3D A New Dimension in Cinema Sound" pp. 1-11.

* cited by examiner

METHOD AND APPARATUS FOR CONVERTING A CHANNEL-BASED 3D AUDIO SIGNAL TO AN HOA AUDIO SIGNAL

TECHNICAL FIELD

The invention relates to a method and to an apparatus for converting a channel-based 3D audio signal to an HOA audio signal using primary ambient decomposition.

BACKGROUND

With the emerging of different immersive audio technologies such as channel-based approaches like Auro-3D [9] or NHK 22.2 [10] and higher order Ambisonics (HOA), it is desirable to find a reasonable way of converting audio channels to HOA coefficients and vice versa. One of the advantages of HOA is its rendering flexibility to arbitrary loudspeaker setups. On one hand it is simple to convert HOA coefficients to audio channels by means of an HOA renderer using channel positions as speaker positions. On the other hand, it could be argued that conversion of audio channels to HOA coefficients can be carried out by passing audio channels to HOA encoding employing channel positions as directional information.

SUMMARY OF INVENTION

However, audio channels are typically a mix of directional and ambient sound signals in order to meet a good compromise between audio image sharpness for clear localisation of audio sources and spaciousness for an enhanced feeling of envelopment and/or spatial immersion. Therefore, it is more reasonable to extract directional signals inherent in audio channels and corresponding directional information for HOA encoding. In this context, primary ambient decomposition (PAD) techniques can be employed.

A problem to be solved by the invention is to provide an HOA audio signal from a channel-based 3D audio signal. This problem is solved by the method disclosed in claim 1. An apparatus that utilises this method is disclosed in claim 2. Advantageous additional embodiments of the invention are disclosed in the respective dependent claims.

The processing described below converts audio channels in 3D audio into HOA by means of primary ambient decomposition. This conversion is performed as follows:

- Triangulation according to channel positions, so that audio channels are divided into non-overlapping triangles with three-channel positions as vertices;
- Successive primary ambient decomposition for triplets in order to derive directional and ambient signals in each triplet;
- Deriving directional information of the total directional signal for each triplet and HOA encoding the total directional signal according to derived directions;
- Ambient signals are encoded to HOA according to channel positions;
- Superimposing HOA coefficients corresponding to directional and ambient signals in order to obtain the total HOA coefficients of the input audio channels.

In principle, the inventive method is adapted for converting a channel-based 3D audio signal to a higher-order Ambisonics HOA audio signal, said method including:

- if said channel-based 3D audio signal is in time domain, transforming said channel-based 3D audio signal from time domain to frequency domain;

- carrying out a primary ambient decomposition for three-channel triplets of blocks of said frequency domain channel-based 3D audio signal, wherein related directional signals and ambient signals are provided for each triplet;
- from said directional signals, deriving directional information of a total directional signal for each triplet;
- HOA encoding said total directional signal according to said derived directions, and HOA encoding ambient signals according to channel positions;
- superimposing HOA coefficients of said HOA encoded directional signal and HOA coefficients of said HOA encoded ambient signal in order to obtain an HOA coefficients signal for said channel-based 3D audio signal;
- transforming said HOA coefficients signal to time domain.

In principle the inventive apparatus is adapted for converting a channel-based 3D audio signal to a higher-order Ambisonics HOA audio signal, said apparatus including means adapted to:

- if said channel-based 3D audio signal is in time domain, transform said channel-based 3D audio signal from time domain to frequency domain;
- carry out a primary ambient decomposition for three-channel triplets of blocks of said frequency domain channel-based 3D audio signal, wherein related directional signals and ambient signals are provided for each triplet;
- from said directional signals, derive directional information of a total directional signal for each triplet;
- HOA encode said total directional signal according to said derived directions, and HOA encode ambient signals according to channel positions;
- superimpose HOA coefficients of said HOA encoded directional signal and HOA coefficients of said HOA encoded ambient signal in order to obtain an HOA coefficients signal for said channel-based 3D audio signal;
- transform said HOA coefficients signal to time domain.

BRIEF DESCRIPTION OF DRAWINGS

Exemplary embodiments of the invention are described with reference to the accompanying drawings, which show in.

DESCRIPTION OF EMBODIMENTS

Even if not explicitly described, the following embodiments may be employed in any combination or sub-combination.

A. System Description

The system is defined under an audio analysis and synthesis framework. That is, individual audio channels are transformed to the frequency domain by means of an analysis filter bank such as FFT. After frequency domain processing, signals are converted to the time domain via a synthesis filter bank such as IFFT. In order to avoid artefacts at block boundaries, windowing and overlapping are performed during the analysis, while windowing and overlap-add are carried out during synthesis. In the sequel, the analysis process is denoted as T-F, while the synthesis process is denoted as F-T.

A.1 Triangulation

Figure 1:
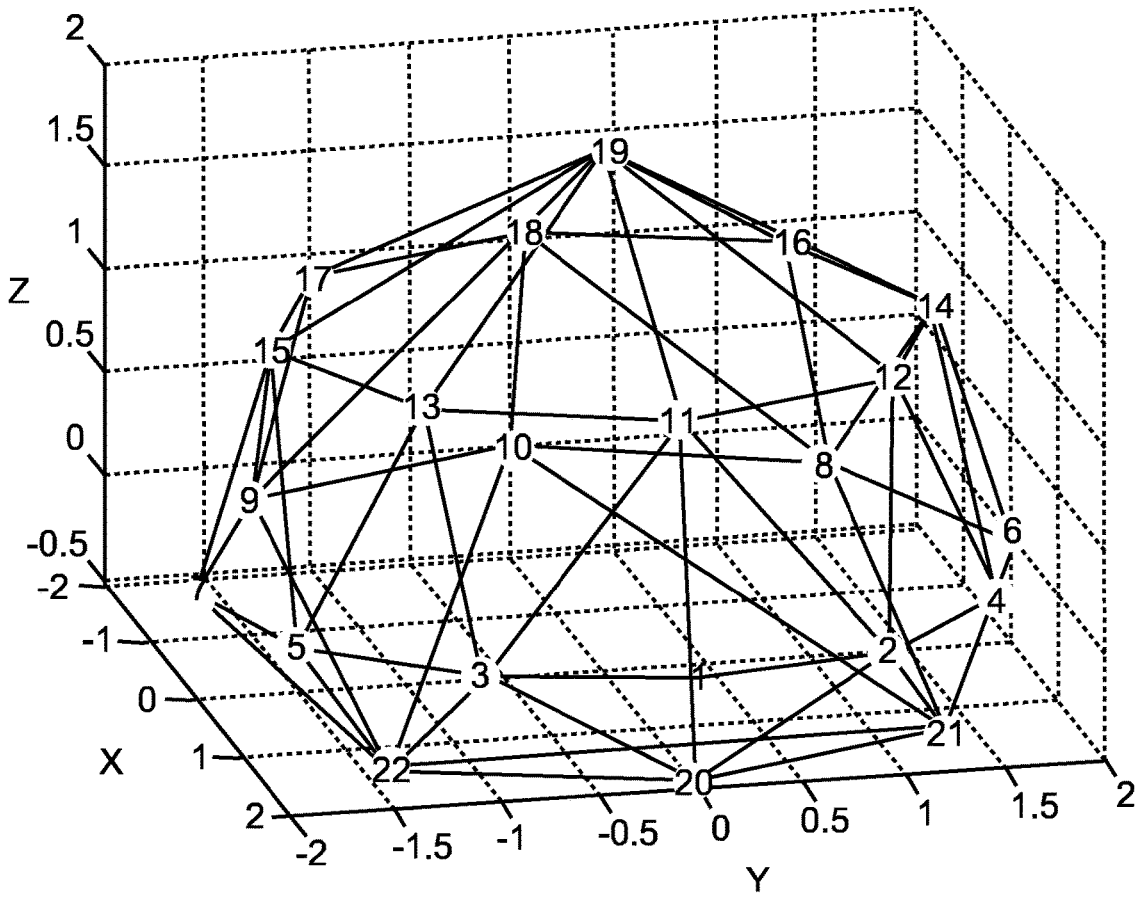
FIG. 1 Triangulation of NHK 22 channels into 40 triangles.

Given input channel positions in 3D space on a unit sphere, triangulation can be accomplished by means of a Delaunay triangulation [7] using the Quickhull algorithm [8], so that triplets consisting of three channels can be obtained. FIG. 1 shows the triangulation results for NHK 22 channels, which comprises four levels, namely a bottom layer with three channels, indicated by vertices 20 to 22, a middle layer with ten channels 1 to 10, a height layer with eight channels 11 to 18, and a top layer with channel 19.

In case there are only three input audio channels, no triangulation is carried out. In the following, the term 'triplet' is also used for such three audio channels.

A.2 Successive Primary-Ambient Decomposition PAD

PAD decomposes individual channel signals into directional and ambient components by exploiting inter-channel correlation. It is assumed that a directional signal is a correlated signal among channels, while ambient signals are uncorrelated with each other and are also uncorrelated with directional signals. Accordingly, directional signals provide localisation, while ambient signals deliver spatial impression.

For triplets, e.g. obtained from triangulation, PAD is carried out successively. Different strategies can be employed to determine in which order the successive decomposition is carried out. One way is to decide the decomposition order according to triplet powers. That means, a triplet with a higher total power is decomposed earlier than a triplet with a lower total power, where the total power is the sum of three channel powers belonging to a triplet.

Given the decomposition order, PAD is carried out for individual triplets, which delivers directional and ambient signals of three channels.

A.3 HOA Encoding

For each triplet, three directional signals are combined to a total directional signal according to the principle of summing localisation, while the directions can be derived by means of panning laws. As a result, the total directional signal is converted to HOA.

For ambient signals, channel positions serve as direction to convert ambient signals to HOA. The addition of the HOA converted directional signal and the ambient signal forms the HOA signal for the considered triplet. Summing HOA signals of all triplets results in the HOA signal for the input channel signals.

Figure 2:
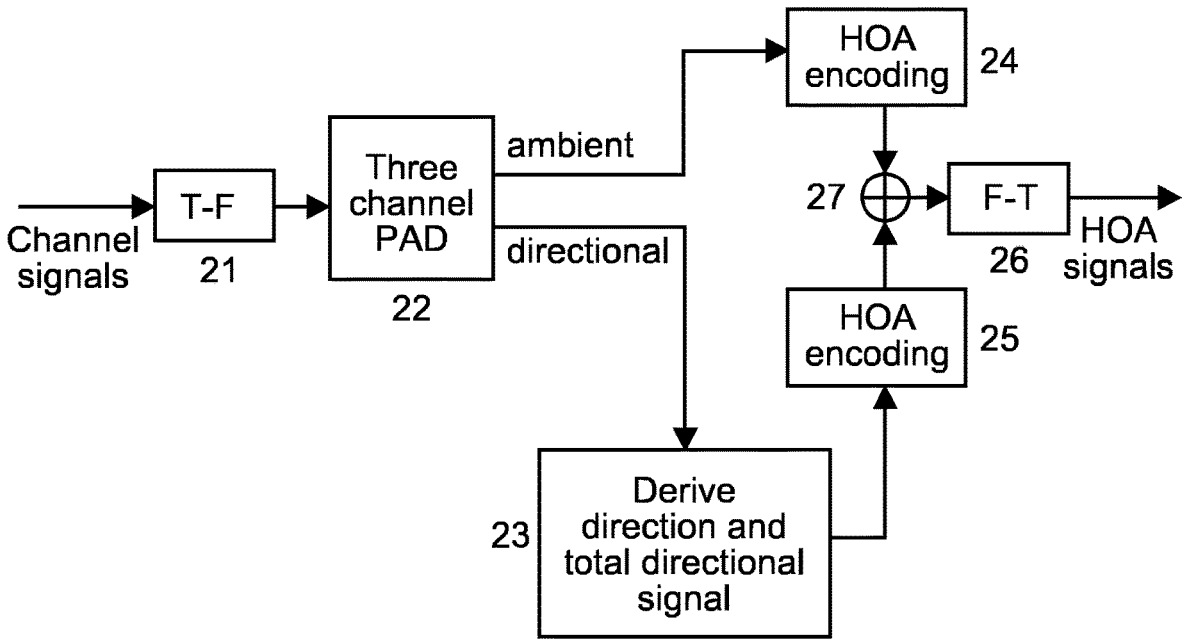
FIG. 2 Converting triplet channel signals to HOA signals.

FIG. 2 illustrates the processing chain for three channels of a triplet within the analysis-synthesis framework. In the following sections, individual modules in FIG. 2 are explained in more detail. Three-channel PAD is used as generalisation of the approach in [2] in order to enter the complex filter bank domain (i.e. complex spectra), and to get three channels using a channel model in order to explicitly take into account spatial cues like inter-channel phase and/or delay difference.

B. Three-Channel Primary-Ambient Decomposition

Let $\{x_m[k], 1 \le m \le 3\}$ denote time-domain audio samples for a specific triplet after triangulation. The primary-ambient decomposition in step or stage 22 in FIG. 2 is carried out in the frequency domain downstream a time-to-frequency transform step or stage 21 using e.g. a short-time Fourier transform. The corresponding spectra are denoted as $\{X_m[k,i], 1 \le m \le 3\}$, where k denotes the k-th audio signal block following the transform and i is the frequency bin index. $X_m[k,i]$ is the input signal in step 31 in FIG. 3. For notational simplicity, the block index k is dropped in the sequel. Accordingly, the channel model is as follows:

$$X_m[i]=A_m[i]e^{j\theta_m[i]}S[i]+N_m[i], 1 \le m \le 3, \tag{1}$$

where $A_m[i]e^{j\theta_m[i]}S[i]$ is the directional component present in individual channels, and $\{N_m[i]\}$ are uncorrelated ambient components. That is, $$E\{N_m[i]N_n^*[i]\}=\sigma_m^2[i]\delta(m-n),$$

$$E\{N_n[i]S^*[i]\}=0,$$

$$E\{(A_m[i]e^{j\theta_m[i]}S[i])(A_m[i]e^{-j\theta_m[i]}S^*[i])\}=A_m^2[i]P_S[i], \tag{2}$$

where $E\{.\}$ denotes statistical expectation, $(.)^*$ denotes conjugate complex, n denotes a channel and $\delta(.)$ is the discrete-time delta function. Accordingly, $A_m[i] \ge 0$ denotes a positive amplitude panning gain.

The model represented by equation (1) takes three different spatial cues into account, namely, inter-channel level difference indicated by $A_m[i]$ and inter-channel delay/phase differences indicated by $\theta_m[i]$, where inter-channel delay differences can be interpreted as frequency-dependent phase differences as shown in [4] and [6]. Note that the channel model presented in [2] only considers inter-channel level differences.

Primary-ambient decomposition can be carried out in three steps:

Directional and ambient power estimation;

Linear spectral estimation based on minimum mean square error principle;

Post-scaling of estimated spectra for power maintenance.

In the following, three-channel PAD is described for individual steps, employing the channel model of equation (1).

B.1 Directional and Ambient Power Estimation

According to the model assumptions in equation (2), signal powers for individual channels can be evaluated in step 32 as $$P_m[i] = E\{|X_m[i]|^2\} = \underbrace{A_m^2[i]P_S[i]}_{P_{S_m}[i]} + \sigma_m^2[i]. \tag{3}$$

And cross correlations between the m-th channel signal and the n-th channel signal are determined in step 32 as $$c_{mn}[i]=E\{X_m[i]X_n^*[i]\}=A_m[i]A_n[i]e^{j(\theta_m[i]-\theta_n[i])}P_S[i], \quad m \ne n. \tag{4}$$

Without loss of generality, the n-th channel is defined as reference channel with $\theta_n[i] \equiv 0$ and $A_m[i] \equiv 1$. Therefore, $A_m[i]$ and $\theta_m[i]$ are relative to the n-th channel. Consequently, $$c_{mn}[i]=E\{X_m[i]X_n^*[i]\}=A_m[i]e^{j\theta_m[i]}P_S[i], m \ne n. \tag{5}$$

The advantage of introducing a reference channel is to avoid an explicit gain and angle estimation for individual channels, which will become clear during the derivation process. Signal powers and cross correlations can empirically be estimated either by a moving average or by recursion using a forgetting factor as follows:

$$\hat{P}_m[k, i] = \frac{1}{K}\sum_{q=0}^{K-1} |X_m[k-q, i]|^2 \tag{6}$$

-continued $$\hat{P}_m[k, i] = \lambda \left| X_m[k, i] \right|^2 + (1-\lambda)\hat{P}_m[k-1, i],$$

$$\hat{c}_{mn}[k, i] = \frac{1}{K}\sum_{q=0}^{K-1} X_m[k-q, i]X_n^*[k-q, i],$$

$$\hat{c}_{mn}[k, i] = \lambda(X_m[k, i]X_n^*[k, i]) + (1-\lambda)\hat{c}_{mn}[k-1, i].$$

For simplicity, instead of $\hat{P}_m[.]$ and $\hat{c}_{mn}[.]$, $P_m[.]$ and $c_{mn}[.]$ will be used in the sequel as estimated signal powers and cross correlations.

The directional signal power $P_{S_m}[i]$ is resolved in step 33 by means of $c_{mn}[i]$:

$$P_{S_m}[i] = \frac{|c_{mn_1}[i]||c_{mn_2}[i]|}{|c_{n_1n_2}[i]|}, m \neq n_1, \quad (7)$$

$$m \neq n_2, n_1 \neq n_2, 1 \leq m, n_1, n_2 \leq 3,$$

and the ambient power is estimated by inserting equation (7) into equation (3) as $$\sigma_m^2[i] = P_m[i] - \frac{|c_{mn_1}[i]||c_{mn_2}[i]|}{|c_{n_1n_2}[i]|}, \quad (8)$$

wherein $c_{n_1n_2}[i]$ is the cross correlation for the i-th frequency bin between the $n_1$-th channel and the $n_2$-th channel, see equation (4).

The problem associated with using the cross correlation ratio for estimating $P_{S_m}[i]$ of equation (7) is that it cannot be guaranteed that the estimated ambient power in equation (8) is non-negative. Therefore, the estimated directional power in equation (7) is post-processed in step 34, such that the estimated directional power, denoted as $P_{S_m}^{(1)}[i]$, is (i) less than $P_m[i]$ for sure and (ii) approaching $P_{S_m}[i]$ as far as possible.

If the estimated channel signal power $P_m[i]$ is greater than or equal to the estimated directional signal power $P_{S_m}[i]$, i.e. $P_m[i] \geq P_{S_m}[i]$, $P_{S_m}^{(1)}[i]$ is set to $P_{S_m}[i]$.

If the estimated channel signal power $P_m[i]$ is smaller than the estimated directional signal power $P_{S_m}[i]$, i.e. $P_m[i] < P_{S_m}[i]$, a function for limiting $P_{S_m}[i]$ can be $$P_{S_m}^{(1)}[i] = \beta P_m[i]\left(1 - e^{-\alpha \frac{P_{S_m}[i]}{P_m[i]}}\right), \quad (9)$$

which increases by ratio $$\frac{P_{S_m}[i]}{P_m[i]}$$

and is limited to $\beta P_m[i]$. Parameter $\beta$ is a positive value near '1', e.g. $\beta$=0.99. Parameter $\alpha$ controls how fast $P_{S_m}^{(1)}[i]$ approaches $\beta P_m[i]$, e.g. $\alpha$=1.3. When employing the post-processed directional signal power, a non-negative ambient power can always be guaranteed.

Setting $P_{S_m}^{(1)}[i] = P_m[i]$ for the $P_m[i] > P_{S_m}[i]$ case will result in ambient powers equal to zero, which however causes audible artefacts in experiments.

In summary, bin-wise directional and ambient power estimation is carried out in step 31-34 as follows:

- Evaluate spectra of individual channels by a time-frequency transform such as short-time Fourier transform in order to get $\{X_m[i], 1 \leq m \leq M\}$;
- Estimate signal powers and inter-channel cross correlations as $\{P_m[i]\}$ and $\{c_{mn}[i]\}$, see equation (6);
- Estimate directional signal powers $\{P_{S_m}[i]\}$ according to equation (7);
- Post-process estimated directional signal powers like in equation (9) in order to guarantee that (i) the estimated ambient powers are non-negative and (ii) the post-processed estimated directional signal powers well approximate the originally estimated ones in equation (7);
- Estimate ambient powers based on post-processed estimated directional powers as $\sigma_m^2[i] = P_m[i] - P_{S_m}^{(1)}[i]$.

For notational simplicity, $P_{S_m}[i]$ instead of $P_{S_m}[i]$ is used as post-processed directional powers in the following.

B.1.1 Band-Wise Evaluation

Based on bin-wise estimation results, band-wise counterparts can also be evaluated, where frequency bins are divided into bands like critical bands or equivalent rectangular bandwidth bands. The intention is on the one hand the computational efficiency with band-wise evaluation, and on the other hand averaging in band-wise evaluation may reduce estimation errors associated with bin-wise evaluation.

Let the bin index range for the b-th frequency band be $[b_l, b_u]$. Band signal power and band-wise inter-channel cross correlation can be defined, similarly as in [3]:

$$P_{m,b} = \Sigma_{i=b_l}^{b_u} P_m[i], c_{mn,b} = \Sigma_{i=b_l}^{b_u} c_{mn}[i]. \quad (10)$$

Similarly, directional and ambient band powers can be defined as $$P_{S_m,b} = \Sigma_{i=b_l}^{b_u} P_{S_m}[i], \sigma_{m,b}^2 = P_{m,b} - P_{S_m,b} = \Sigma_{i=b_l}^{b_u} \sigma_m^2[i]. \quad (11)$$

B.2 Spectral Linear Minimum Mean Square Error (LMMSE) Estimation

B.2.1 Directional Signal

Linear spectral estimation for the directional signal in the reference channel based on input channels reads $\hat{S}[i] = \Sigma_{m=1}^{M} w_{S_m}[i] X_m[i]$, and the estimation error signal becomes $$e_S[i] = \hat{S}[i] - S[i] = (\Sigma_{m=1}^{M} w_{S_m}[i] A_m[i] e^{j\theta_m[i]} - 1) S[i] + \Sigma_{m=1}^{M} w_{S_m}[i] N_m[i].$$

The linear estimation coefficients can be evaluated based on the principle of orthogonality in order to minimise the mean squared error $E\{|e_S[i]|^2\}$. It can be shown that $$w_{S_n}[i] = \frac{PAR_n[i]}{R_s[i]+1}, w_{S_m}[i] = \frac{c_{nm}[i]/\sigma_m^2[i]}{R_s[i]+1} \text{ for } m \neq n, \quad (12)$$

where the primary-to-ambient ratio (PAR) can be defined for individual channels and for each frequency bin as $PAR_m[i] = P_{S_m}[i]/\sigma_m^2[i]$ and the sum of PARs is defined as $R_s[i] = \Sigma_{m=1}^{M} PAR_m[i]$.

Alternatively, band-wise estimation coefficients can be evaluated based on band-wise evaluated primary, ambient powers and cross correlations:

$$w_{S_n,b} = \frac{PAR_{n,b}}{R_{s,b}+1}, w_{S_m,b} = \frac{c_{nm,b}/\sigma_{m,b}^2}{R_{s,b}+1}, m \neq n \quad (13)$$

by defining band-wise PARs as $PAR_{m,b}=P_{S_m,b}/\sigma_{m,b}^2$ and the sum of band-wise PARs as $R_{s,b}=\Sigma_{m=1}^{M} PAR_{m,b}$ in step 36. Accordingly, band-wise spectral estimation of the directional signal from the reference channel based on band-wise coefficients leads in step 37 to $$\hat{S}_b[i]=\Sigma_{m=1}^{M} w_{S_m,b} X_m[i], \text{ for } i\in[b_l,b_u]. \tag{14}$$

That is, for bins in the same frequency band the coefficients for spectral estimation are same.

Given $\hat{S}[i]$, directional signals in other channels can be evaluated as $$\hat{S}_m[i] = A_m[i]e^{j\theta_m[i]}\hat{S}[i] = \frac{c_{mn}[i]}{P_S[i]}\hat{S}[i],\ m \neq n \tag{15}$$

according to equation (5). Their band-wise counterparts are evaluated in step 37 as $$\hat{S}_{m,b}[i] = \frac{c_{mn,b}}{P_{S,b}}\hat{S}_b[i], \text{ for } i \in [b_l, b_u],\ m \neq n. \tag{16}$$

It is obvious that all estimates solely depend on estimated powers and inter-channel cross correlation, while no explicit estimation of gains and angles like $A_m[i]$ and $\theta_m[i]$ is necessary.

B.2.2 Ambient Signals

Linear spectral estimation for ambient signals is $$\hat{N}_{m'}[i]=\Sigma_{m=1}^{M} w_{N_{m'},m}[i]X_m[i].$$

And the estimation coefficients minimising the mean square estimation error become $$w_{N_{m'},m'}[i] = \frac{1 + R_s[i] - PAR_{m'}[i]}{R_s[i] + 1}, \tag{17}$$

$$w_{N_{m'},m}[i] = \frac{-c_{m'm}[i]/\sigma_m^2[i]}{R_s[i] + 1},\ m \neq m'.$$

Similarly as before, band-wise weights can be evaluated as $$w_{N_{m'},m',b} = \frac{1 + R_{s,b} - PAR_{m',b}}{R_{s,b} + 1}, \tag{18}$$

$$w_{N_{m'},m,b} = \frac{-c_{m'm,b}/\sigma_{m,b}^2}{R_{s,b} + 1},\ m \neq m'.$$

And ambient spectral estimation based on band-wise coefficients is carried out in step 37 as $$\hat{N}_{m',b}[i]=\Sigma_{m=1}^{M} w_{N_{m'},m,b} X[i], \text{ for } i\in[b_l,b_u] \tag{19}$$

Again, all estimates only depend on estimated powers and inter-channel cross correlations, while no explicit estimation of gains and angles for individual channels is necessary.

B.3 Post-Scaling

To maintain directional and ambient powers before and after decomposition, a post-scaling is performed in step 38. The directional power from the reference channel after linear spectral estimation is evaluated by $$P_{\hat{S}}[i] = E\{\hat{S}[i]\hat{S}^*[i]\} = \frac{R_s[i]}{R_s[i] + 1}P_S[i]. \tag{20}$$

The ambient power after linear spectral estimation is determined as $$P_{\hat{N}_m}[i] = \left(1 - \frac{PAR_m[i]}{1 + R_s[i]}\right)\sigma_m^2[i],\ 1 \leq m \leq M. \tag{21}$$

According to equations (20) and (21), directional and ambient powers statistically are actually attenuated due to linear spectral estimation. To undo this attenuation, post-scaling is carried out as $$\hat{S}'[i] = \sqrt{\frac{P_S[i]}{P_{\hat{S}}[i]}}\hat{S}[i] = \sqrt{\frac{R_s[i] + 1}{R_s[i]}}\hat{S}[i], \tag{22}$$

$$\hat{S}'_m[i] = \frac{c_{mn}[i]}{P_S[i]}\hat{S}'[i],\ m \neq n,$$

$$\hat{N}'_m[i] = \sqrt{\frac{\sigma_m^2[i]}{P_{\hat{N}_m}[i]}}\hat{N}_m[i] = \sqrt{\frac{1 + R_s[i]}{1 + R_s[i] - PAR_m[i]}}\hat{N}_m[i].$$

If band-wise estimation coefficients are used for the spectral estimation, band-wise powers can be defined by $$P_{\hat{S},b} = \frac{R_{s,b}}{R_{s,b} + 1}P_{S,b},\ P_{\hat{N}_m,b} = \left(1 - \frac{PAR_{m,b}}{1 + R_{s,b}}\right)\sigma_{m,b}^2, \tag{23}$$

and the post-scaling is performed for $i\in[b_l,b_u]$ by $$\hat{S}'_b[i] = \sqrt{\frac{P_{S,b}}{P_{\hat{S},b}}}\hat{S}_b[i] = \sqrt{\frac{R_{s,b} + 1}{R_{s,b}}}\hat{S}_b[i], \tag{24}$$

$$\hat{S}'_{m,b}[i] = \frac{c_{mn,b}}{P_{S,b}}\hat{S}'_b[i],\ m \neq n,$$

$$\hat{N}'_{m,b}[i] = \sqrt{\frac{P_{\hat{N}_m,b}}{\sigma_{m,b}^2}}\hat{N}_{m,b}[i] = \sqrt{\frac{1 + R_{s,b}}{1 + R_{s,b} - PAR_{m,b}}}\hat{N}_{m,b}[i].$$

Figure 3:
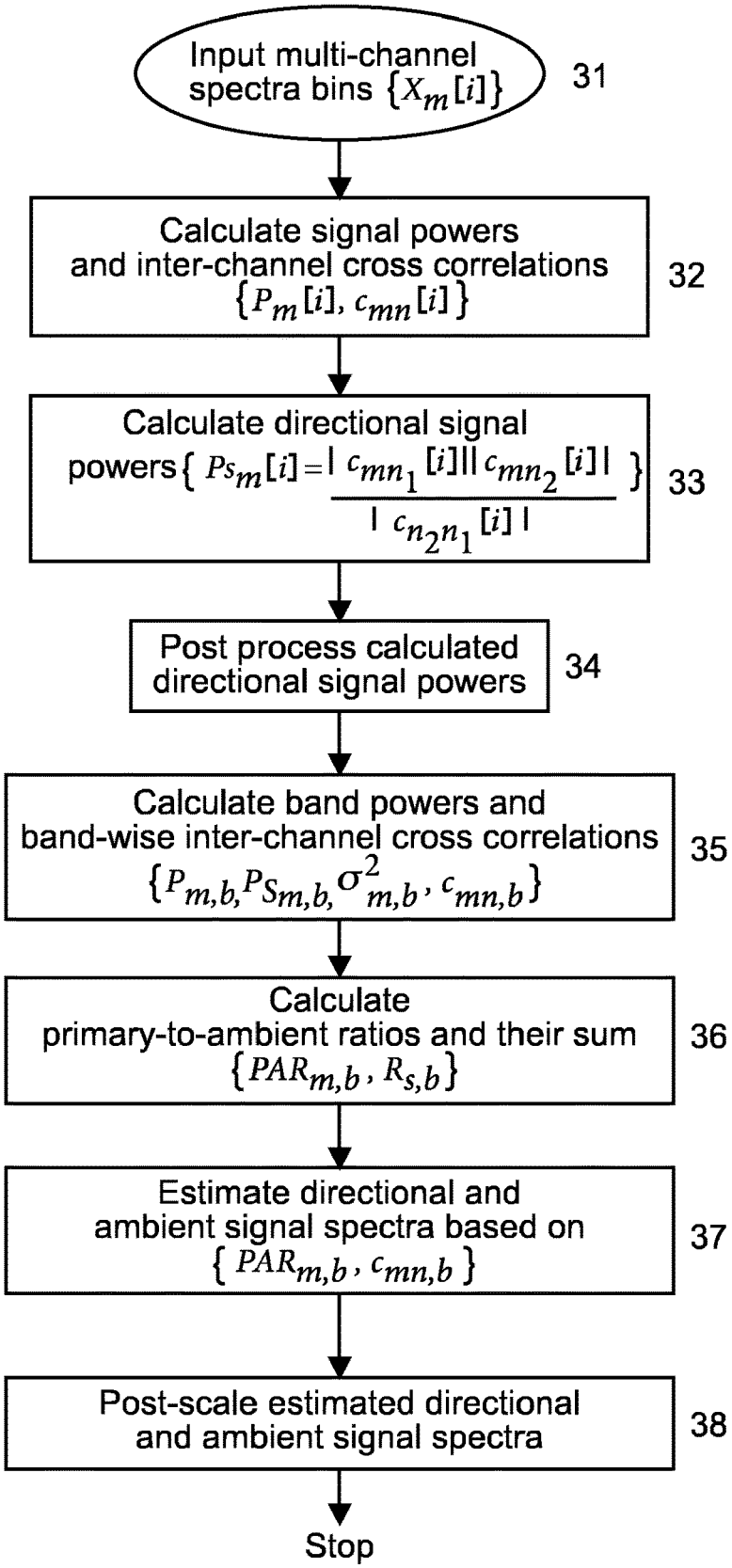
FIG. 3 Flow diagram for multi-channel primary-ambient decomposition.

The flow chart in FIG. 3 illustrates the multi-channel primary-ambient decomposition employing band-wise coefficients for linear spectral estimation and post-scaling. A related block diagram employing bin-wise coefficients looks correspondingly, which is clear according to the derivation process.

C. Directional Signal and Directional Information

Given estimated directional signals from individual channels $\{\hat{S}'_m[i], 1\leq m\leq 3\}$, a total directional signal and its direction can be derived, which can be used for HOA encoding and rendering. This is the inverse problem to reproduction of directional sound via loudspeakers, where individual feeds for loudspeakers are derived from a directional signal. For loudspeakers located in the horizontal plane, a tangent panning law is known, see [5] and [2]. For three-dimensional panning, vector based amplitude panning (VBAP) can be applied, cf. [5], or its generalisation can be applied, cf. [1].

In the following, it is shown how to derive the total directional signal by applying the principle of VBAP, while the principle shown in [1] can be employed similarly.

C.1 Horizontal Plane Case

Figure 4:
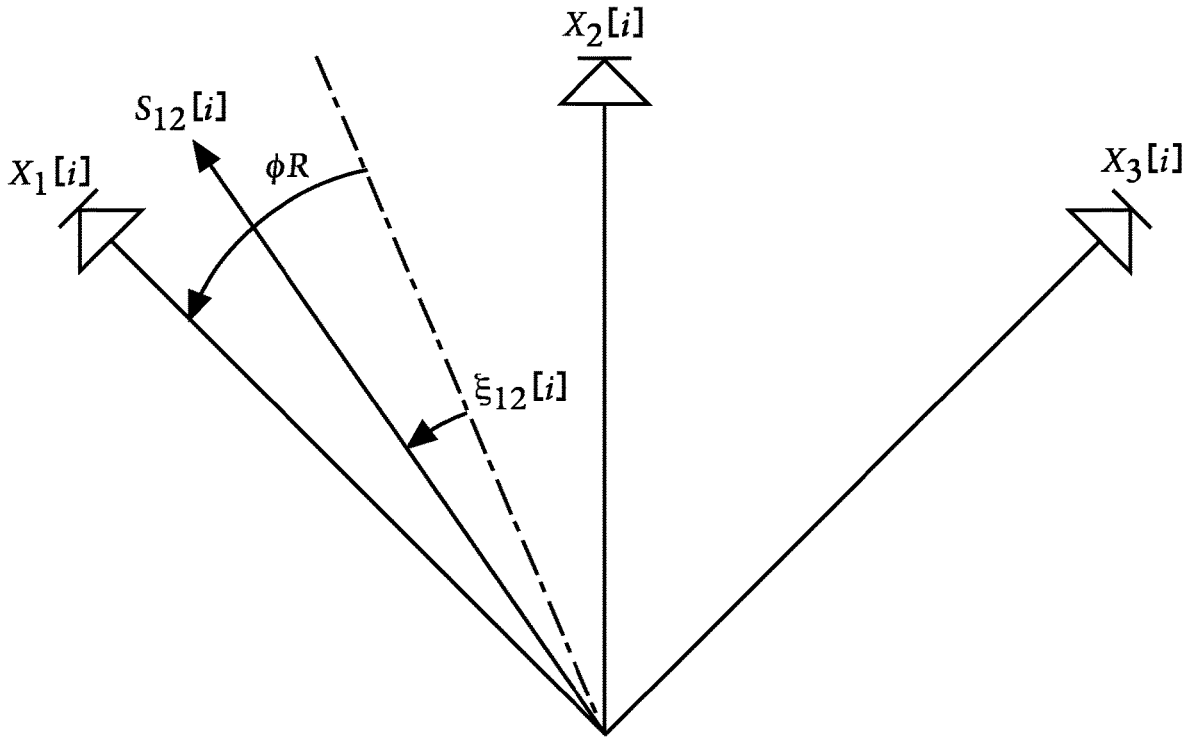
FIG. 4 Panning angle $\phi_{12}[i]$ and reference angle $\phi_R$ for direction determination.

A three-channel case as depicted in FIG. 4 is considered, where three channels are located on the horizontal plane. Without loss of generality, the first channel serves as reference channel. After decomposition, directional signals are estimated as $\hat{S}'_1[i], \hat{S}'_2[i], \hat{S}'_3[i]$.

A total directional signal can be derived by two successive steps. First, a directional signal located between the first and second channels is determined, which is denoted as $S_{12}[i]$. After that, $S_{12}[i]$ is combined with $\hat{S}'_3[i]$ in order to derive the total directional signal. Based on the estimated directional powers $P_{S_1}[i]$ and $P_{S_2}[i]$, a panning angle for the first and second channels can be determined by means of the tangent law according to [5] and [2]:

$$\xi_{12}[i] = \tan^{-1}\left(\tan(\phi_R)\frac{\sqrt{P_{S_1}[i]} - \sqrt{P_{S_2}[i]}}{\sqrt{P_{S_1}[i]} + \sqrt{P_{S_2}[i]}}\right), \tag{25}$$

where $$\phi_R = \phi_1 - \frac{1}{2}(\phi_1 + \phi_2) \in \left[0, \frac{\pi}{2}\right].$$

$\phi_1$ and $\phi_2$ denote azimuth angles for the first and second loudspeakers, respectively. For $P_{S_1}[i] \gg P_{S_2}[i]$, $\xi_{12}[i] \rightarrow \phi_R$, and for $P_{S_2}[i] \gg \xi_{12}[i] \rightarrow -\phi_R$. The directional signal $S_{12}[i]$ and its direction are then given as $$S_{12}[i] = \sqrt{1 + \frac{P_{S_2}[i]}{P_{S_1}[i]}}\,\hat{S}'[i],\ \phi_{12}[i] = \xi_{12}[i] + \frac{\phi_1 + \phi_2}{2}. \tag{26}$$

Similarly, $S_{12}[i]$ is combined with $\hat{S}'_3[i]$ to derive the total directional signal and its direction. The panning angle is determined as $$\xi_{123}[i] = \tan^{-1}\left(\tan(\phi_{R,3}[i])\frac{\sqrt{P_{S_1}[i] + P_{S_2}[i]} - \sqrt{P_{S_3}[i]}}{\sqrt{P_{S_1}[i] + P_{S_2}[i]} + \sqrt{P_{S_3}[i]}}\right), \tag{27}$$

where bin-wise reference angles $\phi_{R,3}[i] = \frac{1}{2}(\phi_{12}[i] - \phi_3)$ with $\phi_3$ denote the azimuth angle corresponding to the third loudspeaker. Consequently, the final directional signal and its direction are obtained as $$S_{123}[i] = \sqrt{1 + \frac{P_{S_2}[i]}{P_{S_1}[i]} + \frac{P_{S_3}[i]}{P_{S_1}[i]}}\,\hat{S}'[i], \tag{28}$$

$$\phi_{123}[i] = \xi_{123}[i] + \frac{\phi_{12}[i] + \phi_3}{2}.$$

This successive approach for evaluating panning angles and the direction of the total directional signal can be applied for multi-channel cases with more than three channels, if directions of multi-channel signals are all on the horizontal plane.

C.2 Three-Dimensional Case

In the three-channel case, with channel positions now located on a unit sphere, channel positions can be represented by a unit vector with Cartesian coordinates as its elements, denoted as $p_1$, $p_2$, and $p_3$. The bin-wise position (direction) of the total directional signal on the unit sphere can be determined as $$p[i] = \frac{1}{\sqrt{P_{S_1}[i] + P_{S_2}[i] + P_{S_3}[i]}}\left(p_1\sqrt{P_{S_1}[i]} + p_2\sqrt{P_{S_2}[i]} + p_3\sqrt{P_{S_3}[i]}\right). \tag{29}$$

That is, the direction determination of the total directional signal for three-channel cases is the inverse problem of VBAP. For two channels that are not located on the horizontal plane, the direction can similarly be determined as $$p[i] = \frac{1}{\sqrt{P_{S_1}[i] + P_{S_2}[i]}}\left(p_1\sqrt{P_{S_1}[i]} + p_2\sqrt{P_{S_2}[i]}\right). \tag{30}$$

Therefore, for cases with more than three channels, equations (28) and (29) can be applied successively for determining the direction of the total directional signal. In an example with four channels with $p_1$, $p_2$, $p_3$ and $p_4$ as channel position vectors, the direction evaluation can be accomplished in two steps. Firstly, the direction summarising first three directional signals from first three channels can be determined as $$p_{123}[i] = \frac{1}{\sqrt{P_{S_1}[i] + P_{S_2}[i] + P_{S_3}[i]}}\left(p_1\sqrt{P_{S_1}[i]} + p_2\sqrt{P_{S_2}[i]} + p_3\sqrt{P_{S_3}[i]}\right) \tag{31}$$

with the corresponding directional power $P_{S_{123}}[i] = P_{S_1}[i] + P_{S_2}[i] + P_{S_3}[i]$. Next, the final direction summarising four directional signals can be calculated by applying equation (30):

$$p[i] = \frac{1}{\sqrt{P_{S_{123}}[i] + P_{S_4}[i]}}\left(p_{123}[i]\sqrt{P_{S_{123}}[i]} + p_4\sqrt{P_{S_4}[i]}\right),$$

with the corresponding directional power as $P_S[i] = P_{S_1}[i] + P_{S_2}[i] + P_{S_3}[i] + P_{S_4}[i]$.

Replacing bin-wise estimates with their band-wise counterparts, the total directional signal and its direction can be determined similarly.

D. Conversion to HOA

Based on derived directional signal $S_{123}[i]$ and its corresponding bin-wise directional information $\phi_{123}[i]$ for the horizontal plane case or $p_{123}[i]$ for the 3D case, HOA encoding in frequency domain can be carried out in step or stage 25 in FIG. 2 as $$b_S[i] = S_{123}[i]y(\Omega_S[i]), \tag{32}$$

where $\Omega_S[i]$ denotes direction according to $\phi_{123}[i]$ or $p_{123}[i]$ and $y(\Omega_S[i])$ is the mode vector dependent on $\Omega_S[i]$, see section E. HOA basics for its definition. For band-wise approaches, $\Omega_S[i]$ is the same for all frequency bins within a same frequency band.

For ambient signals $\{\hat{N}'_m[i]\}$, HOA encoding is carried out in step or stage 24 on FIG. 2 as $$b_{N,m}[i] = \{\hat{N}'_m[i]\}y(\Omega_m), \tag{33}$$

where $\Omega_m$ is the channel position of the m-th channel. Consequently, the frequency-domain HOA coefficients for the considered triplet can be evaluated in step or stage 27 as $$b[i]=b_S[i]+\Sigma_{m=1}^{3}b_{N,m}[i]. \quad (34)$$

Finally, combining all HOA coefficients from individual triplets completes the conversion from channel signals to HOA signals. The frequency domain HOA signal is then transformed back into the time domain in step or stage 26.

E. HOA Basics

Figure 5:
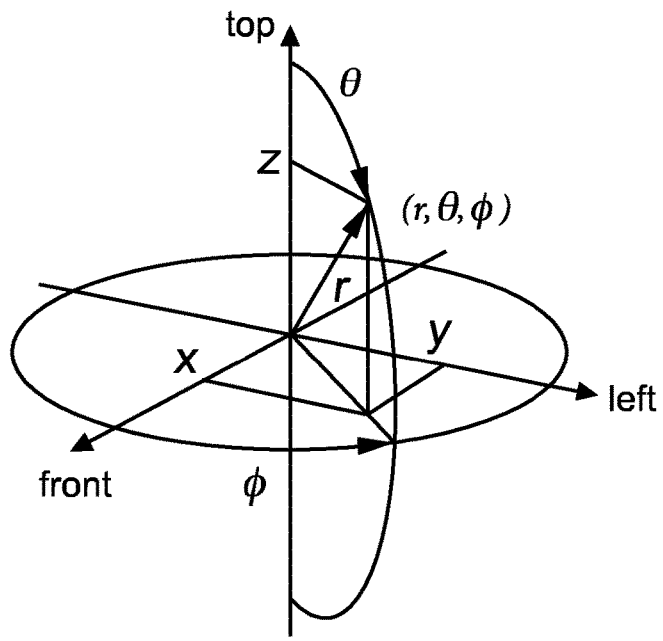
FIG. 5 Spherical coordinate system.

Higher Order Ambisonics (HOA) is based on the description of a sound field within a compact area of interest, which is assumed to be free of sound sources, cf. e.g. sections 12 Higher Order Ambisonics (HOA) and C.5 HOA Encoder in [13]. In that case the spatio-temporal behaviour of the sound pressure p(t,x) at time t and position $\hat{\Omega}$ within the area of interest is physically fully determined by the homogeneous wave equation. In the following a spherical coordinate system as shown in FIG. 5 is assumed. In this coordinate system the x axis points to the frontal position, the y axis points to the left, and the z axis points to the top. A position in space $\hat{\Omega}=(r,\theta,\phi)^T$ is represented by a radius r>0 (i.e. the distance to the coordinate origin), an inclination angle $\theta\in[0,\pi]$ measured from the polar axis z and an azimuth angle $\phi\in[0,2\pi]$ measured counter-clockwise in the x-y plane from the x axis. Further, $(.)^T$ denotes the transposition.

Then it can be shown [11] that the Fourier transform of the sound pressure with respect to time denoted by $\mathcal{F}_t(.)$, i.e. $P(\omega,\hat{\Omega})=\mathcal{F}_t(p(t,\hat{\Omega}))=\int_{-\infty}^{\infty}p(t,\hat{\Omega})e^{-i\omega t}dt$ with ω denoting the angular frequency and i indicating the imaginary unit, can be expanded into a series of Spherical Harmonics according to $$P(\omega=kc_s,r,\theta,\phi)=\Sigma_{n=0}^{N}\Sigma_{m=-n}^{n}A_n^m(k)j_n(kr)Y_n^m(\theta,\phi).$$

Here $c_s$ denotes the speed of sound and k denotes the angular wave number, which is related to the angular frequency ω by $$k=\frac{\omega}{c_s}.$$

Further, $j_n(.)$ denote the spherical Bessel functions of the first kind and $Y_n^m(\theta,\phi)$ denote the real-valued Spherical Harmonics of order n and degree m, which are defined below. The expansion coefficients $A_n^m(k)$ only depend on the angular wave number k. Thereby it has been implicitly assumed that the sound pressure is spatially band-limited. Thus the series is truncated with respect to the order index n at an upper limit N, which is called the order of the HOA representation.

If the sound field is represented by a superposition of an infinite number of harmonic plane waves of different angular frequencies ω and arriving from all possible directions specified by the angle tuple (θ,ϕ), it can be shown [12] that the respective plane wave complex amplitude function B(ω,θ,ϕ) can be expressed by the following Spherical Harmonics expansion $B(\omega=kc_s,\theta,\phi)=\Sigma_{n=0}^{N}\Sigma_{m=-n}^{n}B_n^m(k)Y_n^m(\theta,\phi)$, where the expansion coefficients $B_n^m(k)$ are related to the expansion coefficients $A_n^m(k)$ by $A_n^m(k)=i^nB_n^m(k)$.

Assuming that the individual coefficients $B_n^m(\omega=kc_s)$ are functions of the angular frequency ω, the application of the inverse Fourier transform (denoted by $\mathcal{F}^{-1}(.)$) provides time domain functions $$b_n^m(t)=\mathcal{F}_t^{-1}(B_n^m(\omega/c_s))=\frac{1}{2\pi}\int_{-\infty}^{\infty}B_n^m\left(\frac{\omega}{c_s}\right)e^{i\omega t}d\omega$$

for each order n and degree m, which can be collected in a single vector b(t) by $$b(t)=[b_0^0(t)b_1^{-1}(t)b_1^0(t)b_1^1(t)b_2^{-2}(t)b_2^{-1}(t)b_2^0(t)b_2^1(t)\ b_2^2(t)\ \ldots\ b_N^{N-1}(t)]^T$$

The position index of a time domain function $b_n^m(t)$ within vector b(t) is given by n(n+1)+1+m. The overall number of elements in vector b(t) is given by $O=(N+1)^2$.

The final Ambisonics format provides the sampled version b(t) using a sampling frequency $f_S$ as $$\{b(lT_S)\}_{l\in N}=\{b(T_S),b(2T_S),b(3T_S),b(4T_S),\ldots\},$$

where $T_S=1/f_S$ denotes the sampling period. The elements of $b(lT_S)$ are here referred to as Ambisonics coefficients. The time domain signals $b_n^m(t)$ and hence the Ambisonics coefficients are real-valued.

E.1 Definition of Real Valued Spherical Harmonics

The real-valued spherical harmonics $Y_n^m(\theta,\phi)$ (assuming N3D normalisation) are given by $$Y_n^m(\theta,\phi)=\sqrt{(2n+1)\frac{(n-|m|)!}{(n+|m|)!}}\,P_{n,|m|}(\cos\theta)\ trg_m(\phi)$$

$$\text{with } trg_m(\phi)=\begin{cases}\sqrt{2}\cos(m\phi) & m>0\\ 1 & m=0\\ -\sqrt{2}\sin(m\phi) & m<0\end{cases}.$$

The associated Legendre functions $P_{n,m}(x)$ are defined as $$P_{n,m}(x)=(1-x^2)^{m/2}\frac{d^m}{dx^m}P_n(x),\ m\geq 0$$

with the Legendre polynomial $P_n(x)$ and without the Condon-Shortley phase term $(-1)^m$.

E.2 Definition of the Mode Matrix

The mode matrix $\Psi^{(N_1,N_2)}$ of order $N_1$ with respect to the directions $\Omega_q^{(N_2)}$, q=1, . . . , $O_2=(N_2+1)^2$, related to order $N_2$ is defined by $\Psi^{(N_1,N_2)}:=[y_1^{(N_1)}\ y_2^{(N_1)}\ \ldots\ y_{O_2}^{(N_1)}]\in\mathbb{R}^{O_1\times O_2}$ with $y_q^{(N_1)}:=[Y_0^0(\Omega_q^{(N_2)})\ Y_{-1}^{-1}(\Omega_q^{(N_2)})\ Y_{-1}^0(\Omega_q^{(N_2)})\ Y_{-1}^1(\Omega_q^{(N_2)})\ Y_{-2}^{-2}(\Omega_q^{(N_2)})\ Y_{-1}^{-2}(\Omega_q^{(N_2)})\ \ldots\ Y_{N_1}^{N_1}(\Omega_q^{(N_2)})]^T\in\mathbb{R}^{O_1}$ denoting the mode vector of order $N_1$ with respect to the directions $\Omega_q^{(N_2)}$, where $O_1=(N_1+1)^2$.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

REFERENCES

[1] A. Ando, K. Hamasaki, "Sound intensity-based three dimensional panning", Proceedings of the 126th AES Convention, Munich, May 2009

[2] Ch. Faller, "Multiple-Loudspeaker Playback of Stereo Signals", J. Audio Eng. Soc. 54, vol. 2006, pp. 1051-1064

[3] Ch. Faller, F. Baumgarte, "Binaural cue coding, part II: Schemes and applications", IEEE Transactions on Speech and Audio Processing 11, vol. 2003, pp. 520-531

[4] [Merimaa et al. 2007] Merimaa, Juha; Goodwin, Michael M.; Jot, Jean-Marc: Correlation-based ambience extraction from stereo recordings. In: 123rd Convention of the Audio Eng. Soc. New York, 2007

[5] V. Pulkki, "Virtual sound source positioning using vector base amplitude panning", J. Audio Eng. Soc. 45, vol. 1997, June, Nr.6, pp. 456-466

[6] J. Thompson, B. Smith, A. Warner, J.-M. Jot, "Direct-diffuse decomposition of multichannel signals using a system of pairwise correlations", 123rd Convention of the Audio Eng. Soc., San Francisco, 2012

[7] B. Delaunay, "Sur la Sphère Vide", Bulletin de l'academie des sciences de l'URSS, 1934, vol. 1, pp. 793-800

[8] C. B. Barber, D. P. Dobkin, H. Huhdanpaa, "The Quickhull Algorithm for Convex Hulls", CM Transactions on Mathematical Software, 1996, vol. 22, pp. 469-483

[9] http://www.barco.com/projection_systems/downloads/Auro-3D_v3.pdf

[10] http://www.nhk.or.jp/strl/publica/bt/en/fe0045-6.pdf

[11] E. G. Williams, "Fourier Acoustics", 1999, vol. 93 of Applied Mathematical Sciences, Academic Press

[12] B. Rafaely, "Plane-wave Decomposition of the Sound Field on a Sphere by Spherical Convolution", J. Acoust. Soc. Am., 2004, vol. 4(116), pp. 2149-2157

[13] ISO/IEC IS 23008-3

The invention claimed is:

1. A method for converting a channel-based 3D audio signal to a higher-order Ambisonics HOA audio signal, said method including:

if said channel-based 3D audio signal is in time domain, transforming said channel-based 3D audio signal from time domain to frequency domain;

carrying out a primary ambient decomposition for three-channel triplets of blocks of said frequency domain channel-based 3D audio signal, wherein related directional signals and ambient signals are provided for each triplet, and wherein said primary ambient decomposition includes a directional and ambient power estimation, a linear spectral estimation based on minimum mean square error principle, and a post-scaling of the estimated spectra such that power maintenance is achieved;

from said directional signals, deriving directional information of a total directional signal for each triplet;

HOA encoding said total directional signal according to said derived directions, and HOA encoding ambient signals according to channel positions;

superimposing HOA coefficients of said HOA encoded directional signal and HOA coefficients of said HOA encoded ambient signal in order to obtain an HOA coefficients signal for said channel-based 3D audio signal;

transforming said HOA coefficients signal to time domain.

2. The method of claim 1, wherein windowing and overlapping is carried out in connection with said transform from time domain to frequency domain, while windowing and overlap-add is carried out in connection with said transform from frequency, domain to time domain.

3. The method of claim 1, wherein, in case there are more than three channels, a triangulation is performed in that channels of said channel-based 3D audio signal are divided into non-overlapping triangles or triplets with three-channel positions as vertices.

4. The method of claim 3, wherein in case the channel positions of said channel-based 3D audio signal are given in 3D space on a unit sphere, said triangulation is accomplished by means of a Delaunay triangulation using the Quickhull algorithm.

5. The method of claim 1, wherein said primary ambient decomposition for said triplets is carried out successively and the decomposition order is carried out according to triplet powers, such that a triplet with a higher total power is decomposed earlier than a triplet with a lower total power, wherein the total power is the sum of three channel powers belonging to a triplet.

6. The method of claim 1, wherein based on the decomposition order, said primary ambient decomposition is carried out for individual triplets, thereby delivering directional and ambient signals of three channels, and wherein three directional signals are combined to a total directional signal according to the principle of summing localisation, while the directions are derived by means of panning laws.

7. The method of claim 1, wherein said primary ambient decomposition includes:

calculating, for a block ($X_m[i]$) of multichannel spectral bins, signal powers $P_m$ [i] and inter-channel cross correlations $c_{mn}[i]$ between different channel signals, wherein $1 \le m \le 3$ denotes a specific triplet after triangulation, m,n denote two different channels and i denotes a frequency bin index;

calculating a directional signal power $$P_{S_m}[i] = \frac{|c_{mn_1}[i]||c_{mn_2}[i]|}{|c_{n_1n_2}[i]|},$$

$m \neq n_1$, $m \neq n_2$, $n_1 \neq n_2$, $1 \le m$, $n_1$, $n_2 \le 3$, wherein $c_{n_1n_2}[i]$ is the cross correlation for the i-th frequency bin between channel $n_1$ and channel $n_2$, which both are different from channel m;

if calculated said signal power $P_m[i]$ is smaller than directional power $P_{S_m}[i]$, post-processing said directional power $P_{S_m}[i]$ such that it is less than $P_m[i]$ and approaches $P_{S_m}[i]$ as far as possible;

calculating a band signal power $P_{m,b}$, a band-wise inter-channel cross correlation $c_{mn,b}$, a directional band power $P_{S_m,b}$ and an ambient band power $\sigma_{m,b}^2 = P_{m,b} - P_{S_m,b}$, wherein b denotes a band;

calculating a primary-to-ambient ratio $PAR_m[i] = P_{S_m}[i]/\sigma_m^2[i]$ for each individual channel and their sum $$R_s[i] = \sum_{m=1}^{M} PAR_m[i],$$

or calculating a primary-to-ambient ratio $PAR_{m,b} = P_{S_m,b}/\sigma_{m,b}^2$ for each individual band and their sum $$R_{s,b} = \sum_{m=1}^{M} PAR_{m,b};$$

estimating directional and ambient signal spectra based on $PAR_m[i]$ and $c_{mn}[i]$, or based on $PAR_{m,b}$ and $c_{mn,b}$, respectively;

scaling said estimated directional and ambient signal spectra such that an attenuation caused by said spectral estimation is reversed.

8. Digital audio signal that is generated according to the method of claim 1.

9. An apparatus for converting a channel-based 3D audio signal to a higher-order Ambisonics HOA audio signal, said apparatus including at least a processor, wherein the at least processor includes:

if said channel-based 3D audio signal is in time domain, a transform stage configured to transform said channel-based 3D audio signal from time domain to frequency domain;

a decomposition stage configured to carry out a primary ambient decomposition for three-channel triplets of blocks of said frequency domain channel-based 3D audio signal, wherein related directional signals and ambient signals are provided for each triplet, and wherein said primary ambient decomposition includes a directional and ambient power estimation, a linear spectral estimation based on minimum mean square error principle, and a post-scaling of the estimated spectra such that power maintenance is achieved; and at least one other stage configured to:

derive, from said directional signals, directional information of a total directional signal for each triplet;

HOA encode said total directional signal according to said derived directions, and HOA encode ambient signals according to channel positions;

superimpose HOA coefficients of said HOA encoded directional signal and HOA coefficients of said HOA encoded ambient signal in order to obtain an HOA coefficients signal for said channel-based 3D audio signal; and transform said HOA coefficients signal to time domain.

10. The apparatus of claim 9, wherein the transform stage is configured to carry out windowing and overlapping in connection with said transform from time domain to frequency domain, and the at least one other stage is configured to carry out windowing and overlap-add in connection with said transform from frequency domain to time domain.

11. The apparatus of claim 9, wherein, in case there are more than three channels, the decomposition stage is configured to perform a triangulation in that channels of said channel-based 3D audio signal are divided into non-overlapping triangles or triplets with three-channel positions as vertices.

12. The apparatus of claim 11, wherein in case the channel positions of said channel-based 3D audio signal are given in 3D space on a unit sphere, said triangulation is accomplished by means of a Delaunay triangulation using the Quickhull algorithm.

13. The apparatus of claim 9, wherein the decomposition stage is configured to carry out said primary ambient decomposition for said triplets successively and the decomposition order is carried out according to triplet powers, such that a triplet with a higher total power is decomposed earlier than a triplet with a lower total power, wherein the total power is the sum of three channel powers belonging to a triplet.

14. The apparatus of claim 9, wherein based on the decomposition order, the decomposition stage is configured to carry out said primary ambient decomposition for individual triplets, thereby delivering directional and ambient signals of three channels, and wherein three directional signals are combined to a total directional signal according to the principle of summing localisation, while the directions are derived by means of panning laws.

15. The apparatus of claim 9, wherein said decomposition stage is configured to determine primary ambient decomposition including by:

calculating, for a block ($X_m[i]$) of multichannel spectral bins; signal powers $P_m[i]$ and inter-channel cross correlations $c_{mn}[i]$ between different channel signals, wherein $1 \le m \le 3$ denotes a specific triplet after triangulation, m,n denote two different channels and i denotes a frequency bin index;

calculating a directional signal power $$P_{S_m}[i] = \frac{|c_{mn_1}[i]||c_{mn_2}[i]|}{|c_{n_1 n_2}[i]|},$$

$m \ne n_1$, $m \ne n_2$, $n_1 \ne n_2$, $1 \le m, n_1, n_2 \le 3$, wherein $c_{n1n2}[i]$ is the cross correlation for the i-th frequency bin between channel $n_1$ and channel $n_2$, which both are different from channel m;

if calculated said signal power $P_m[i]$ is smaller than directional power $P_{S_m}[i]$, post-processing said directional power $P_{S_m}[i]$ such that it is less than $P_m[i]$ and approaches $P_{S_m}[i]$ as far as possible;

calculating a band signal power $P_{m,b}$, a band-wise inter-channel cross correlation $c_{mn,b}$, a directional band power $P_{S_m,b}$ and an ambient band power $\sigma_{m,b}^2 = P_{m,b} - P_{S_m,b}$, wherein b denotes a band;

calculating a primary-to-ambient ratio $PAR_m[i] = P_{S_m}[i]/\sigma_m^2[i]$ for each individual channel and their sum $$R_s[i] = \sum_{m=1}^{M} PAR_m[i],$$

or calculating a primary-to-ambient ratio $PAR_{m,b} = P_{S_m,b}/\sigma_{m,b}^2$ for each individual band and their sum $$R_{s,b} = \sum_{m=1}^{M} PAR_{m,b};$$

estimating directional and ambient signal spectra based on $PAR_m[i]$ and $c_{mn}[i]$, or based on $PAR_{m,b}$ and $c_{mn,b}$, respectively;

scaling said estimated directional and ambient signal spectra such that an attenuation caused by said spectral estimation is reversed.

* * * * *